US005850838A

United States Patent [19]

Sigrist

[11] Patent Number: 5,850,838

[45] Date of Patent: Dec. 22, 1998

[54] FOLDING SMOKING PIPE WITH COMBINED MOUTHPIECE AND BOWL COVER

[76] Inventor: Erik O. Sigrist, 19275 SW. Anderson, Aloha, Oreg. 97007

[21] Appl. No.: 892,686

[22] Filed: Jul. 14, 1997

[51] Int. Cl.[6] ..... A24F 3/00

[52] U.S. Cl. ..... 131/180; 131/185

[58] Field of Search ..... 131/180, 185; 431/253; 206/86

[56] References Cited

U.S. PATENT DOCUMENTS 4,223,687 9/1980 Sandeen ..... 131/180

*Primary Examiner*—John G. Weiss
*Assistant Examiner*—Charles W. Anderson
*Attorney, Agent, or Firm*—Keith A. Cushing

[57] ABSTRACT

A smoking pipe includes a rotatable coupling between a base including a bowl and mouthpiece. The mouthpiece rotates to a first position covering the bowl and to a second position distant from the bowl for use of the smoking pipe. The collapsed form of the smoking pipe may be more easily carried in one's pocket without loss of debris from the bowl.

5 Claims, 4 Drawing Sheets

FOLDING SMOKING PIPE WITH COMBINED MOUTHPIECE AND BOWL COVER

FIELD OF THE INVENTION

The present invention relates generally to tobacco use appliances, and particularly to pipes used for smoking tobacco.

BACKGROUND OF THE INVENTION

Smoking pipes typically include a bowl receiving tobacco and a conduit coupling the bowl to a mouthpiece whereupon placing tobacco in the bowl, drawing air from the mouthpiece, and applying fire to the tobacco causes tobacco smoke to emerge from the mouthpiece. As the fire consumes the tobacco, a combination of tobacco and ashes remain in the bowl. Eventually, the fire consumes the tobacco and only ashes are left in the bowl. Smokers often only consume a portion of the tobacco in the bowl in a given smoking session.

Some smoking pipes include a cover for the bowl allowing the smoker to contain the ashes and remaining tobacco. When the smoker wishes to later consume the tobacco, the smoker removes the cover and smokes the remaining tobacco. Thus, a cover allows the smoker to engage in multiple smoking sessions without reloading the bowl and without losing tobacco or ashes from the bowl. With such a cover, the smoker carries the smoking pipe in his or her pocket without losing ashes or tobacco into his or her pocket. Unfortunately, smoking pipes often are too big to fit comfortably in a pocket and smokers either cannot enjoy the convenience of carrying the smoking pipe or must endure the discomfort of the smoking pipe in a pocket.

SUMMARY OF THE INVENTION

A smoking pipe under the present invention combines the mouthpiece and bowl cover. A base carries the bowl and includes a conduit. The mouthpiece couples to the base through a rotary coupling whereby the mouthpiece rotates about to cover the bowl when the smoking pipe is not in use. When used, however, the mouthpiece rotates away from the bowl, thereby extending the overall length of the smoking pipe and exposing the bowl for use. Because the smoking pipe collapses to a relatively small overall size, it comfortably fits in the user's pocket without discomfort while also containing remaining tobacco and ashes.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
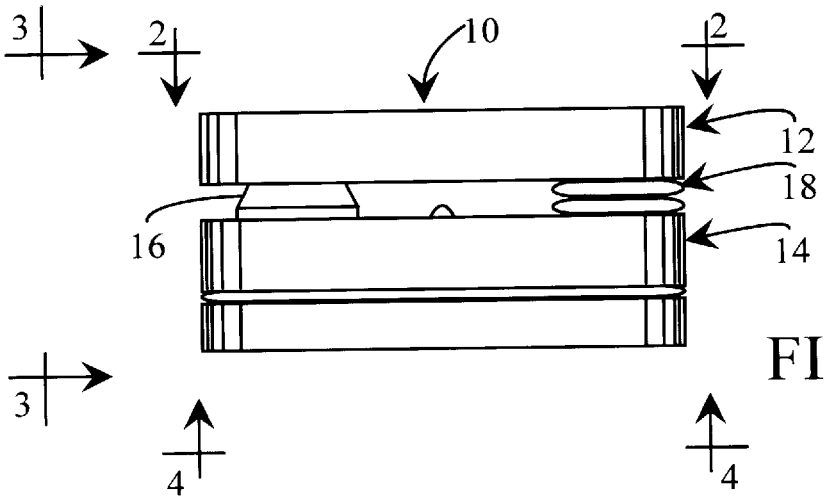
FIG. 1 illustrates a side view of a folding smoking pipe with combined mouthpiece and bowl cover in a collapsed form thereof according to a preferred embodiment of the present invention.
Figure 2:
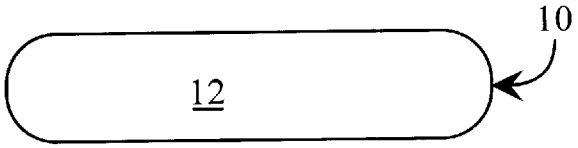
FIG. 2 is a top view of the smoking pipe of FIG. 1 as taken along lines 2—2 of FIG. 1.
Figure 3:
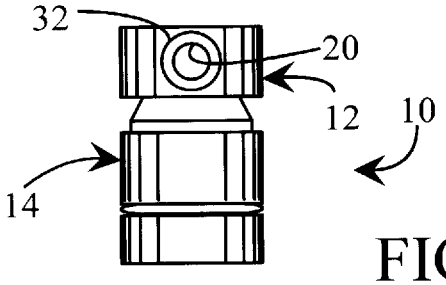
FIG. 3 is an end view of the smoking pipe of FIG. 1 as taken along lines 3—3 of FIG. 1.
Figure 4:
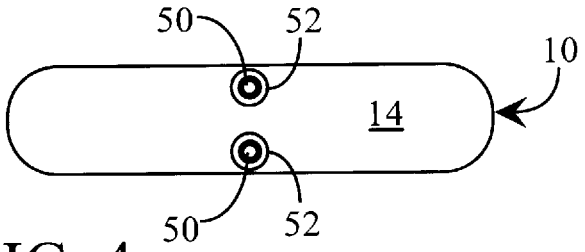
FIG. 4 is a bottom view of the smoking pipe of FIG. 1 as taken along lines 4—4 of FIG. 1.

FIGS. 1–4 illustrate a smoking pipe 10 according to a preferred embodiment of the present invention. Smoking pipe 10 includes a wood mouthpiece 12 and a wood base 14. Base 14 carries a metal bowl 16. In the condition of pipe 10 as illustrated in FIGS. 1–4, mouthpiece 12 covers a top opening of bowl 16. A rotary coupling 18 joins base 14 and mouthpiece 12. Rotary coupling 18 maintains fluid communication between conduits within base 14 and mouthpiece 12. A mouthpiece opening 20 (FIG. 3) thereby fluidly communicates with bowl 16.

Figure 10:
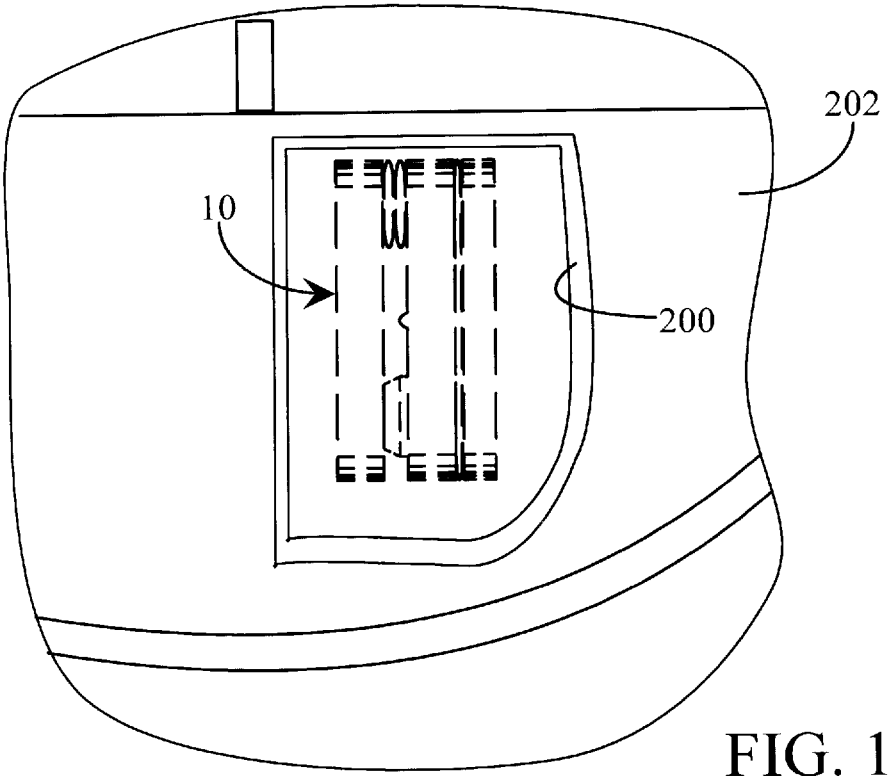
FIG. 10 illustrates placement of the smoking pipe of the present invention in a watch pocket.

Smoking pipe 10 in its collapsed form, i.e., as illustrated in FIGS. 1–4, assumes a generally compact form with the top opening 16*b* of bowl 16 closed by placement of mouthpiece 12 thereover, i.e., by rotating mouthpiece 12 to its position as illustrated in FIGS. 1–4. In such collapsed form, smoking pipe 10 is particularly well suited for carrying in a pocket without discomfort. Unused tobacco in bowl 16 and ashes remaining in bowl 16 are well contained and do not contaminate the pocket. The particular size and shape of smoking pipe 10 has been found particularly well suited for placement in the watch pocket 200 of conventional trousers 202 as shown in FIG. 10.

Figure 5:
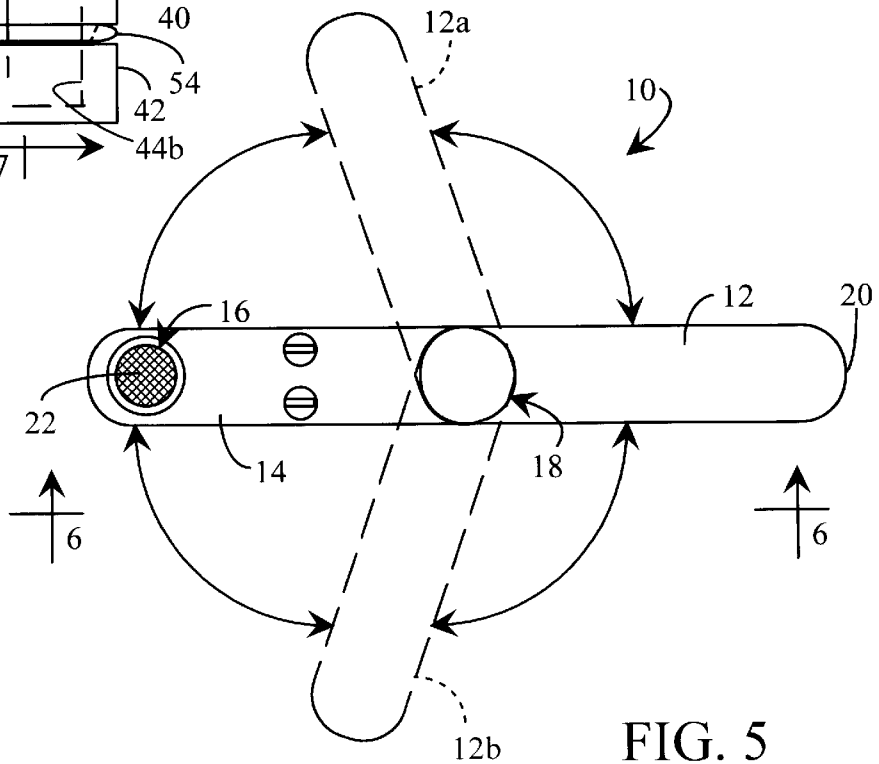
FIG. 5 is a top view of the smoking pipe of FIG. 1, but illustrating the rotatable mouthpiece in its fully extended position, and illustrated in phantom at intermediate positions.

FIG. 5 illustrates smoking pipe 10 in its expanded or operational form. More particularly, mouthpiece 12 has rotated away from bowl 16 upon rotary coupling 18. In this form, mouthpiece opening 20 moves a maximum distance from bowl 16 but remains in fluid communication with bowl 16. Bowl 16 includes therein a screen 22 whereby upon placement of tobacco upon screen 22, drawing of air from mouthpiece 20, and application of fire to the tobacco in bowl 16 causes smoke to pass through smoking pipe 10 and out of mouthpiece opening 20. In the particular embodiment of smoking pipe 10 illustrated herein, mouthpiece 12 rotates freely 360 degrees in both directions about rotary coupling 18. Also, this particular embodiment of the present invention maintains a fluid coupling between mouthpiece opening 20 and bowl 16 throughout its 360 degree range of movement for mouthpiece 12. As may be appreciated, however, fluid coupling between mouthpiece opening 20 and bowl 16 is only necessary when mouthpiece 12 is in an operational position, e.g., as illustrated in FIG. 5. FIG. 5 illustrates in phantom mouthpiece 12 in two intermediate positions along its 360 degree range of movement, i.e., as indicated at reference numerals 12*a* and 12*b*.

Figure 6:
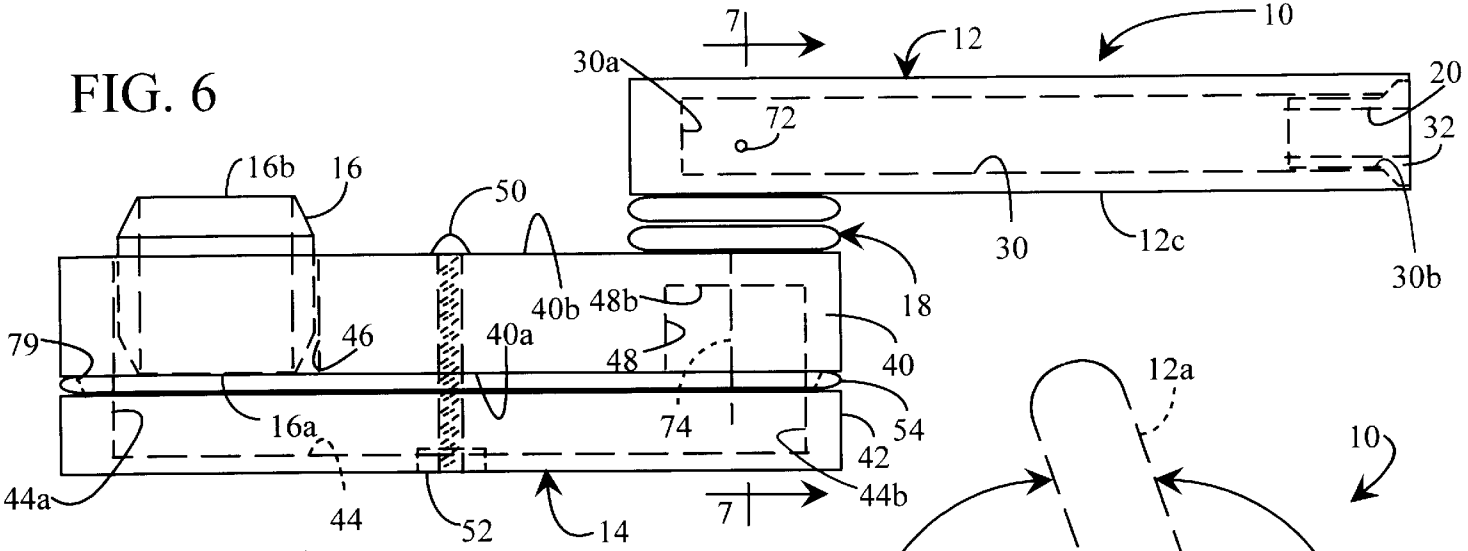
FIG. 6 is a side view of the smoking pipe as illustrated in FIG. 5 and taken along lines 6—6 of FIG. 5 and showing internal conduits of the smoking pipe in phantom.

FIG. 6 illustrates various conduits through smoking pipe 10 establishing a fluid coupling between mouthpiece 20 and bowl 16. Mouthpiece 12 is a wood block having a bore 30 along its length. A closed end 30*a* of bore 30 is adjacent to rotary coupling 18. The open end 30*b* of bore 30 defines mouthpiece opening 20. In the particular embodiment illustrated herein, a tubular metal sleeve 32 inserts into opening 30*b* of bore 30.

Base 14 includes an upper wood block 40 and a lower wood block 42. Lower block 42 includes an upward-facing channel 44. Upper block 40 includes a bore 46 carrying therein bowl 16. Bore 46 lies directly above end 44*a* of channel 44. In this manner, the bottom opening 16*a* of bowl 16 fluidly communicates with end 44*a* of channel 44. Upper block 40 also includes a bore 48, having downward-facing open end 48*a* directly above end 44*b* of channel 44. In this manner, bore 48 fluidly couples with channel 44. As will be described more fully hereafter, the closed end 48*b* of bore 48 fluidly couples with closed end 30*a* of bore 30 through the rotary coupling 18.

A pair of bolts 50 and corresponding recessed nuts 52 join upper block 40 and lower block 42. Also, a rubber O-ring 54 lies intermediate upper block 40 and lower block 42. In this manner, bowl 16, bore 46, channel 44 in combination with the lower surface 40*a* of upper block 40, and bore 48 define a conduit through base 14 coupling bowl 16 and rotary coupling 18.

Figure 7:
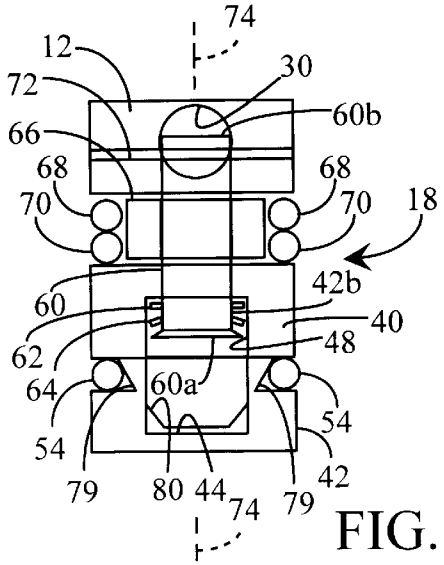
FIG. 7 illustrates in cross section a rotary coupling of the smoking pipe of the present invention as taken along lines 7—7 of FIG. 6.

FIG. 7 illustrates in cross section the rotary coupling 18 responsible for maintaining fluid communication between end 30*a* of bore 30 and end 48*b* of bore 48, i.e., maintaining fluid communication between base 14 and mouthpiece 12. In FIG. 7, brass sleeve 60 passes from bore 48 to bore 30, and thereby establishes fluid communication between bore 48 and bore 30. The lower end of sleeve 60 includes a flange 60*a*. Captured between flange 60*a* and the closed end 48*b* of bore 48 is a flat nylon washer 62, adjacent end 48*b*, and a wave spring washer 64. A nylon bushing 66 surrounds the central portion of sleeve 60 intermediate base 14 and mouthpiece 12. An upper O-ring 68 and lower O-ring 70 surround bushing 66. Bushing 66 and O-rings 68 and 70 establish a selected separation between the downward-facing surface 12*c* of mouthpiece 12 and the top opening 16*b* of bowl 16. In this manner, as mouthpiece 12 rotates to its position above bowl 16, i.e., as illustrated in FIG. 1, the downward-facing surface 12*c* of mouthpiece 12 closes as a cover for bowl 16.

Upper end 60*b* of sleeve 60 extends through mouthpiece 12 and into bore 30, i.e., at end 30*a* of bore 30. A stainless steel pin 72 extends through mouthpiece 12 and the upper end 60*b* of sleeve 60. Pin 72 thereby locks sleeve 72 in position relative to mouthpiece 12. As mouthpiece 12 rotates about an axis 74, sleeve 60 rotates in unison with, i.e., stays in fixed position relative to, mouthpiece 12.

When assembling pipe 10, washers 62 and 64 are placed on sleeve 60 and sleeve 60 is pushed up through upper block 40, through bushing 66 and O-rings 68 and 70, and into conduit 30 of mouthpiece 12. By compressing wave washer 64 and O-rings 68 and 70 and thereafter driving pin 72 through mouthpiece 12 and upper end 60*b* of sleeve 60, a sealed rotatable fluid communication results between bore 48 and bore 30. The compressed nature of O-rings 68 and 70 and washer 64 give a "spring-loaded" mounting for mouthpiece 12 relative to base 14 providing a degree of resiliency therebetween while also maintaining fluid coupling between bore 30 and bore 48.

Figure 8:
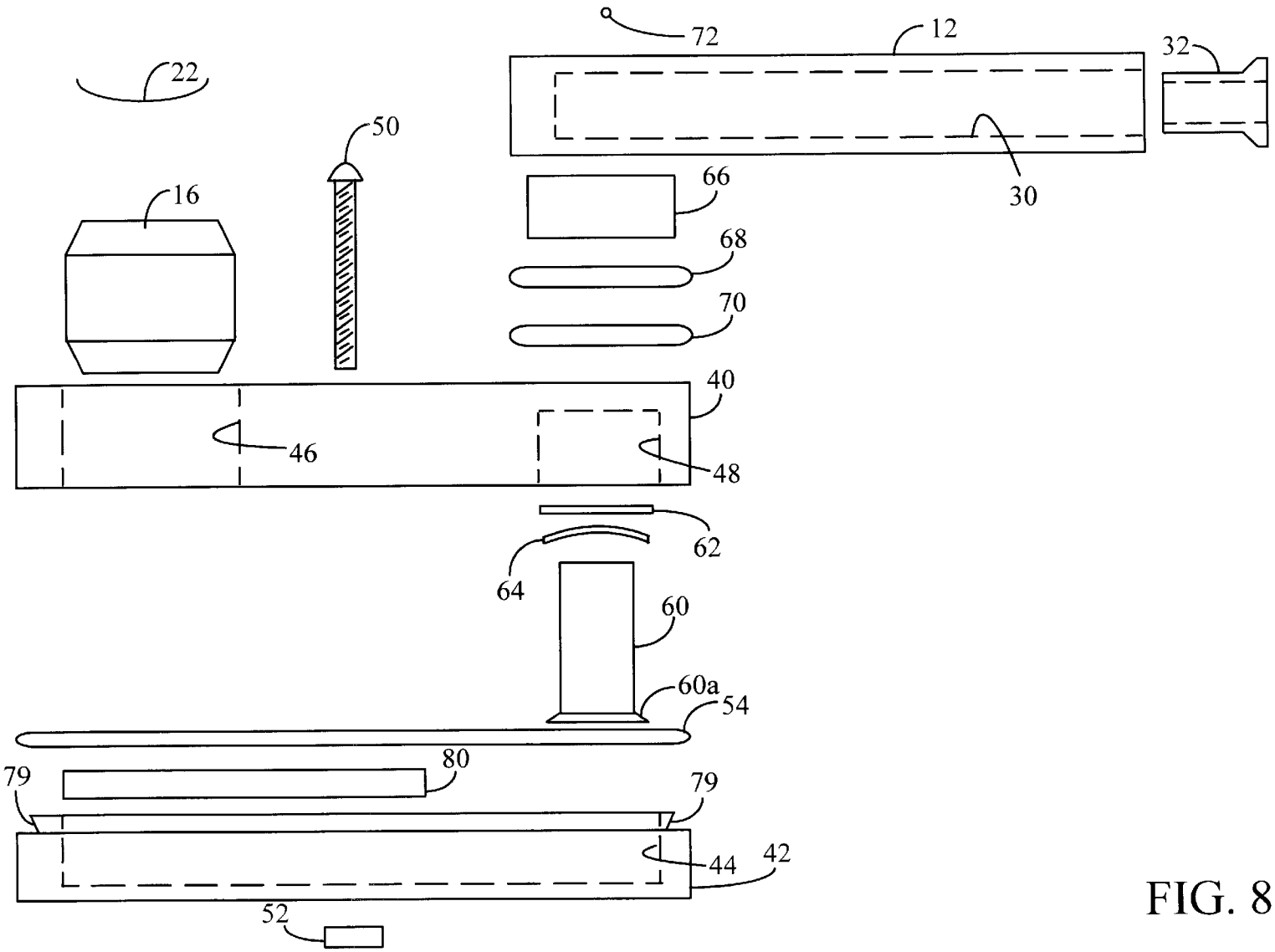
FIG. 8 is an exploded assembly view of the smoking pipe of the present invention.

FIG. 8 illustrates in exploded assembly view the various components of smoking pipe 10. As best seen in FIG. 8, lower block 42 includes an inclined shoulder 79 about its periphery and adopted to hold thereabout the O-ring 54. In addition to the components discussed herein above, a U-shaped metal tray 80 lies within and along the channel 44 and protects channel 44 against heat and debris developed when using pipe 10. Particularly, when using pipe 10 a significant amount of heat passes from bowl 16 into channel 44. When constructing lower block 42 from wood as proposed herein, tray 80 protects block 44 against deterioration due to the high temperature conditions found adjacent the bottom opening 16*a* of bowl 16. Furthermore, significant debris, e.g., tar and material pushing through screen 22, builds near the bottom opening 16*a* of bowl 16. Tray 80 serves to protect block 42 against accumulation of such debris thereon. To clean debris from pipe 10, one merely removes bolts 50 and nuts 52 thereby exposing fully channel 44 for cleaning including removal and cleaning of tray 80. Conventional smoking pipes do not have ability to laterally expose fluid conduits and must be cleaned by "reaming" the conduits from either end.

Figure 9:
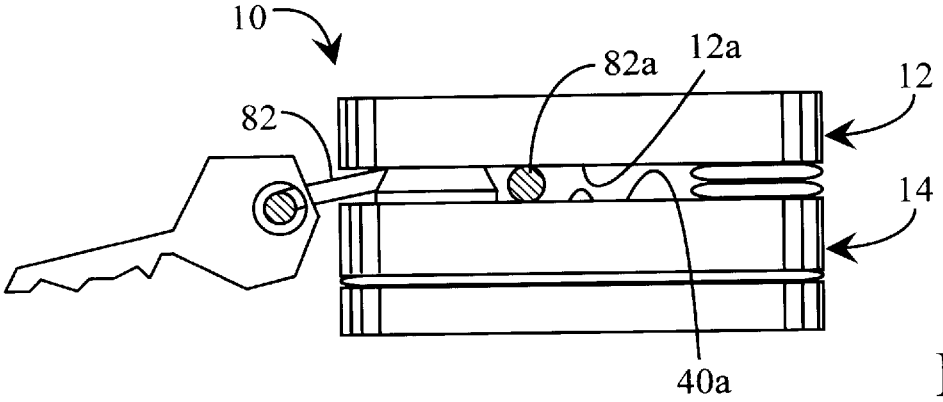
FIG. 9 illustrates attachment of the smoking pipe of the present invention to a key ring.

The particular embodiment of pipe 10 illustrated herein may be conveniently attached to personal items, i.e., a keychain, by virtue of the opening between lower surface 12*c* of mouthpiece 12 and the upper surface 40*b* of upper block 40. FIG. 9 illustrates placement of a ring portion 82*a* of a keyring 82 in the space between surfaces 12*c* and 40*b* with the mouthpiece 12 then rotated into position over bowl 16. Keyring 82 thereby captured between mouthpiece 12 and base 14. In this manner, smoking pipe 10 may be selectively attached to keyring 82 as a keyring ornament.

FIG. 10 illustrates smoking pipe 10 in its collapsed form and located within a watch pocket 202 of conventional trousers 202.

Thus, an improved smoking pipe has been shown and described. The smoking pipe of the present invention combines a mouthpiece and a bowl cover to provide an overall collapsed form of the smoking pipe. In such collapsed form, the smoking pipe may be easily carried in one's pocket, e.g., the watch pocket of conventional trousers, without discomfort. Furthermore, in such collapsed form the mouthpiece covers the bowl to prevent loss of ashes or remaining tobacco products therein while carrying the pipe in one's pocket. The particular embodiment of the present invention illustrated herein may be used to capture a keyring, thereby making the smoking pipe in its collapsed form a keyring ornament for convenient transportation and storage. Under the present invention, the base portion of smoking pipe 10 is bifurcated and may be disassembled to expose fully portions of pipe 10 having significant tar and debris build up. More particularly, base 14 may be disassembled by removing bolts 50 and nuts 52 to expose fully channel 44 whereby trough 80 may be removed and channel 44 and through 80 cleaned of such debris.

It will be appreciated that the present invention is not restricted to the particular embodiment that has been described and illustrated, and that variations may be made therein without departing from the scope of the invention as found in the appended claims and equivalents thereof.

What is claimed is:

1. A smoking pipe comprising:

a bowl;

a first block defining a first conduit therethrough, said first block carrying said bowl in fluid communication with a distal end of said first conduit;

a mouthpiece;

a second block defining a second conduit, said second block carrying said mouthpiece in fluid communication with a distal end of said second conduit, said second block including a downward facing surface in face-to-face relation to said first block; and a rotary coupling establishing fluid communication between a proximal end of said first conduit and a proximal end of said second conduit and allowing one of said first and second blocks to rotate in relation to the other one of said first and second blocks, said first and second blocks being positionable by relative rotation to place said downward facing surface over said bowl to close a top opening of said bowl.

2. A smoking pipe according to claim 1 wherein rotation of said one of said first and second blocks in relation to the other one of said first and second blocks is about an axis of rotation transverse to each said first and second conduits.

3. A smoking pipe according to claim 1 wherein said second block comprises:

an upper portion; and a lower portion, at least one of said upper portion and said lower portion including a channel defining in combination with the other one of said upper portion and said lower portion said second conduit when said upper portion and said lower portion join to form said second block.

4. A smoking pipe comprising:

a bowl having a top opening and a bottom opening;

a base receiving said bowl and including a base conduit in fluid communication with said bottom opening;

a mouthpiece including a mouthpiece conduit and a mouthpiece opening, said mouthpiece opening being in fluid communication with said mouthpiece conduit; and a rotary coupling establishing fluid communication between said base conduit and said mouthpiece conduit and allowing rotation of said mouthpiece relative to said base whereby said mouthpiece selectively rotates to a first position closing said top opening of said bowl and to a second position removed from said bowl.

5. A smoking pipe comprising:

a bowl having a top opening and a bottom opening;

a base carrying said bowl and having a base conduit in fluid communication at a distal end thereof with said bottom opening of said bowl;

a mouthpiece having a mouthpiece opening and a mouthpiece conduit in fluid communication at a distal end thereof with said mouthpiece opening; and a rotary coupling allowing rotation of said mouthpiece relative to said base to a first position wherein a lower surface of said mouthpiece closes said top opening of said bowl and to a second position wherein said mouthpiece is clear of said top opening of said bowl and wherein a proximal end of said base conduit and a proximal end of said mouthpiece conduit are in fluid communication.

* * * * *